US005345749A

United States Patent [19]

Tendick

[11] Patent Number: 5,345,749

[45] Date of Patent: Sep. 13, 1994

[54] BUNDLER

[75] Inventor: Richard C. Tendick, Lakeville, Minn.

[73] Assignee: Greif Brothers Company, Delaware, Ohio

[21] Appl. No.: 5,295

[22] Filed: Jan. 19, 1993

[51] Int. Cl.[5] ..... B65B 13/20; B65B 67/08

[52] U.S. Cl. ..... 53/528; 53/218; 53/590; 53/592

[58] Field of Search ..... 53/528, 526, 523, 590, 53/592, 218, 438, 399

[56] References Cited

U.S. PATENT DOCUMENTS

| | | | |
|---|---|---|---|
| 1,493,946 | 5/1924 | Abbott | 53/528 |
| 1,659,313 | 2/1928 | Cranston | 53/528 X |
| 2,751,731 | 6/1956 | Evers | 53/528 |
| 3,550,349 | 12/1970 | Kerker | 53/528 X |
| 3,650,087 | 3/1972 | Brinkmeier et al. | 53/528 |
| 4,269,557 | 5/1981 | Kidd | 414/105 |
| 4,331,415 | 5/1982 | Blatz et al. | 414/52 |
| 4,481,751 | 11/1984 | Ujhelyi | 53/412 |

*Primary Examiner*—James F. Coan
*Attorney, Agent, or Firm*—Kane, Dalsimer, Sullivan, Kurucz, Levy, Eisele & Richard

[57] ABSTRACT

A bundling apparatus includes a upper and lower platens, at least one of which moves vertically across a plate. The plate is preferably slightly slanted to prevent a stack of articles on the lower platen from toppling over. A continuous wrapping sheet is fed to the plate for wrapping the stack after compression between the platens.

13 Claims, 6 Drawing Sheets

BUNDLER

BACKGROUND OF THE INVENTION

A. Field of Invention

This invention pertains to an apparatus for bundling small, relatively flat objects, and more particularly to an improved apparatus for bundling objects such as bags which are normally compressed prior to tying.

B. Description of the Prior Art

A bundler for flat objects made by the Strong Robinette Machine Company of Bristol, Tennessee, consists of a pair of vertically aligned platens. The bottom platen is disposed on top of an air cylinder used for selective vertical reciprocating movement along a vertical back plate. The top platen is horizontally movable along the back plate by a second air cylinder. This device operates as follows. The end of a continuous sheet of wrapping paper is first led down along the back plate and across the bottom platen. A number of bags are stacked on the bottom platen and the wrapping paper. The top platen is shifted horizontally into alignment with the bottom platen and the vertical air cylinder is activated to compress the bags between the top and bottom platen. A score wheel with a cutter is used to cut the wrapping paper above the top platen after which the operator wraps and tapes the paper about the compressed bag bundle with the top platen extending into the bundle. The bottom platen is moved back to its lower position, leaving the bundle suspended from the top platen. The top platen is shifted horizontally past a stationary stop which forces the bundle off the top platen. The operator catches the bundle, places it on a stack of other bundle and repeats the operation with the next bundle.

A problem with this prior art apparatus is that the space the vertical cylinder under the bottom platen limits the maximum size of the bundle to a small number of bags.

A further problem has been that the machine operates slowly.

Yet another problem has been that because the back plate is vertical, the bundle had a tendency to tip over unless the operator held it with one hand. Obviously this feature rendered the operation both dangerous and cumbersome.

OBJECTIVES AND SUMMARY OF THE INVENTION

In view of the above-mentioned disadvantages of the prior art, it is an objective of the present invention to provide a bundler capable of handling bigger loads.

Yet a further objective is to provide a smaller, more compact apparatus.

A further objective is to provide an apparatus which is automated thereby reducing the number of manual operational steps.

Other objectives and advantages of the invention shall become apparent from the following description.

Briefly, a bundler apparatus for bundling objects comprises support frame means; a back plate mounted on said support frame means and having a front plate surface; a bottom platen mounted on said support frame for holding a stack of articles; a top platen means mounted on said support means; platen reciprocating means for vertically reciprocating one of said top and bottom platens to compress said stack between said platens adjacent to said front surface, said platen reciprocating means including an expanding member disposed away from said front surface.

DETAILED DESCRIPTION OF THE INVENTION

Figure 1:
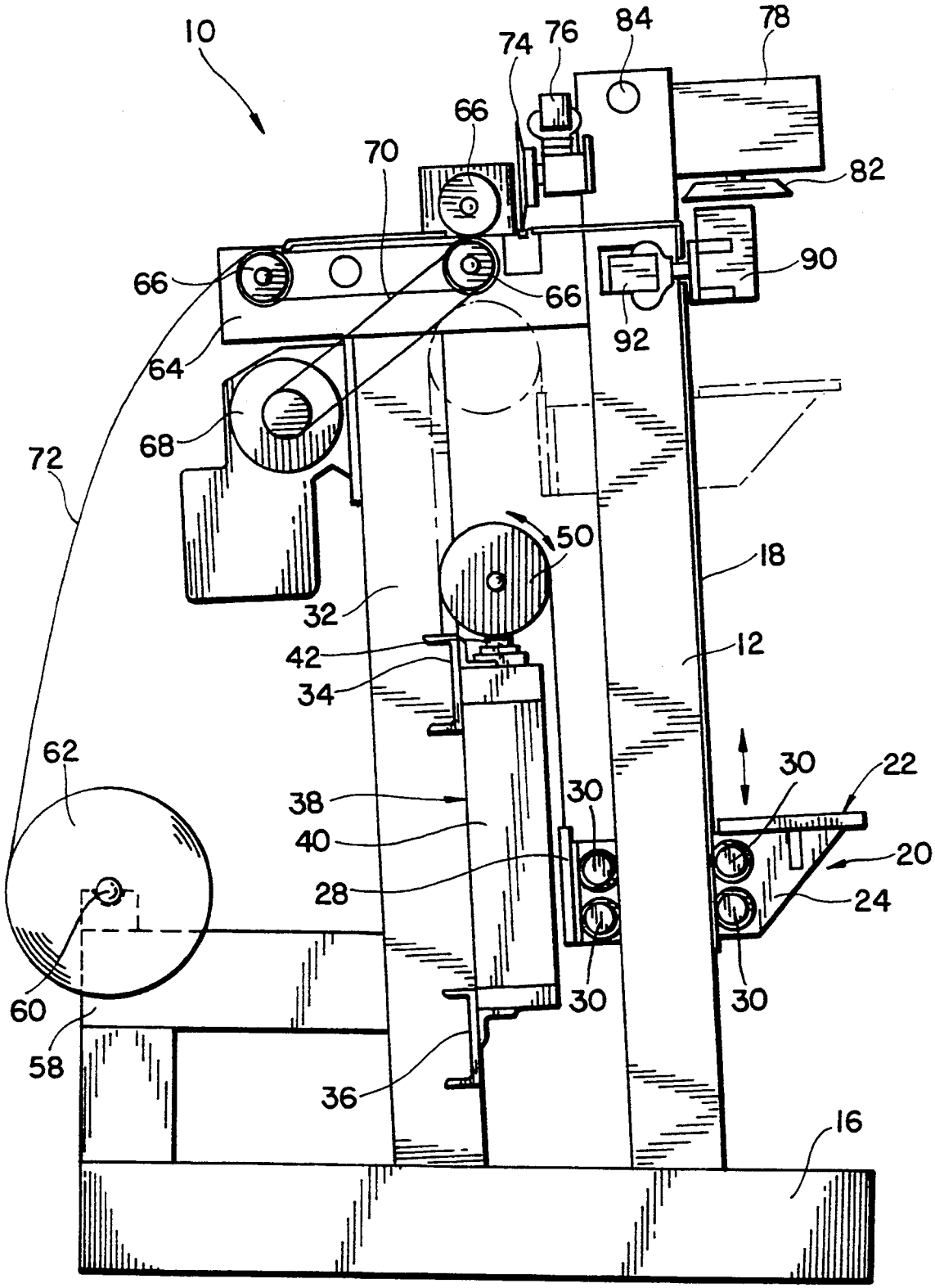
FIG. 1 shows a side elevational cross-sectional view of a bundler apparatus constructed in accordance with this invention.
Figure 2:
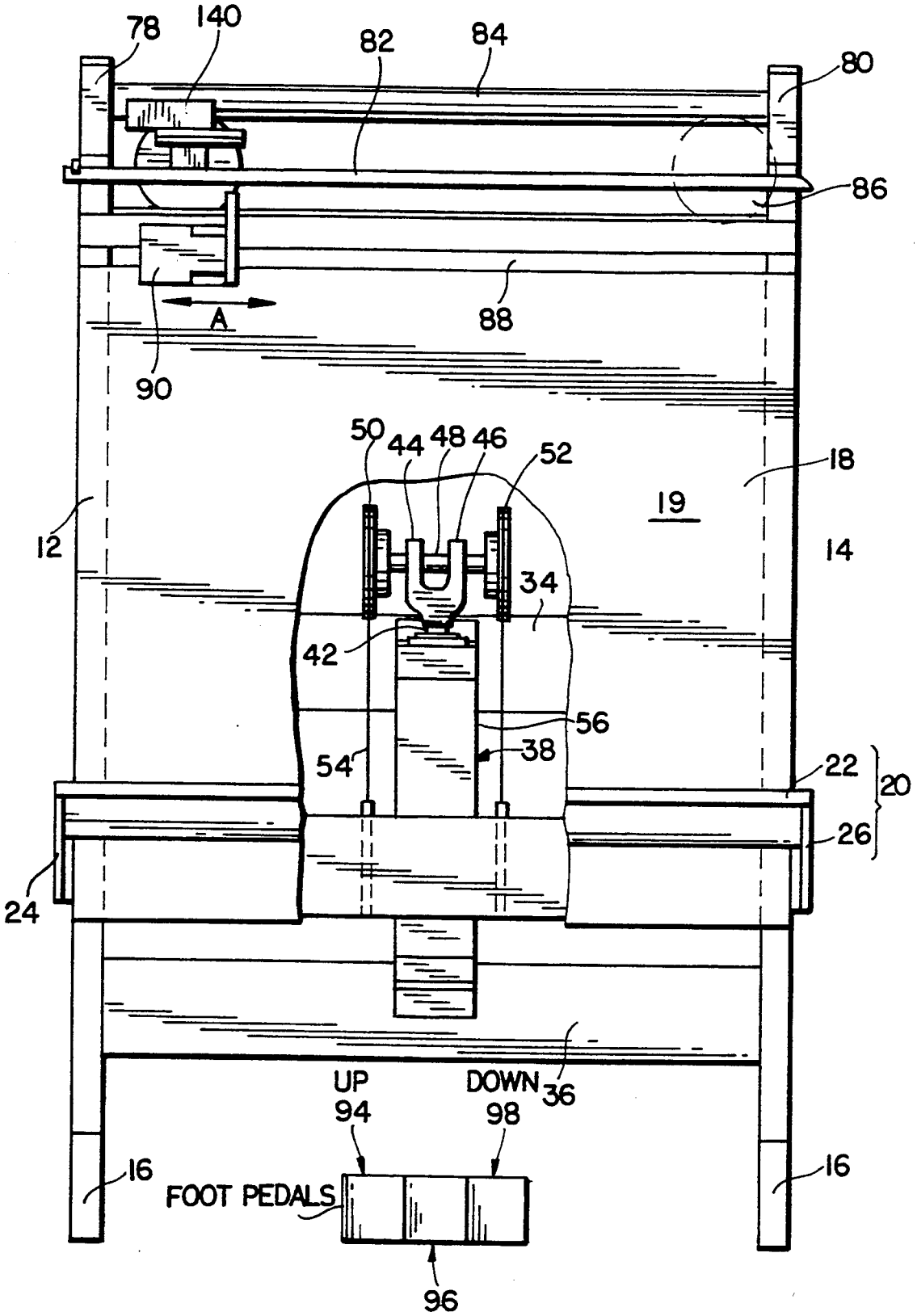
FIG. 2 shows a front elevational view of the apparatus of FIG. 1.
Figure 4:
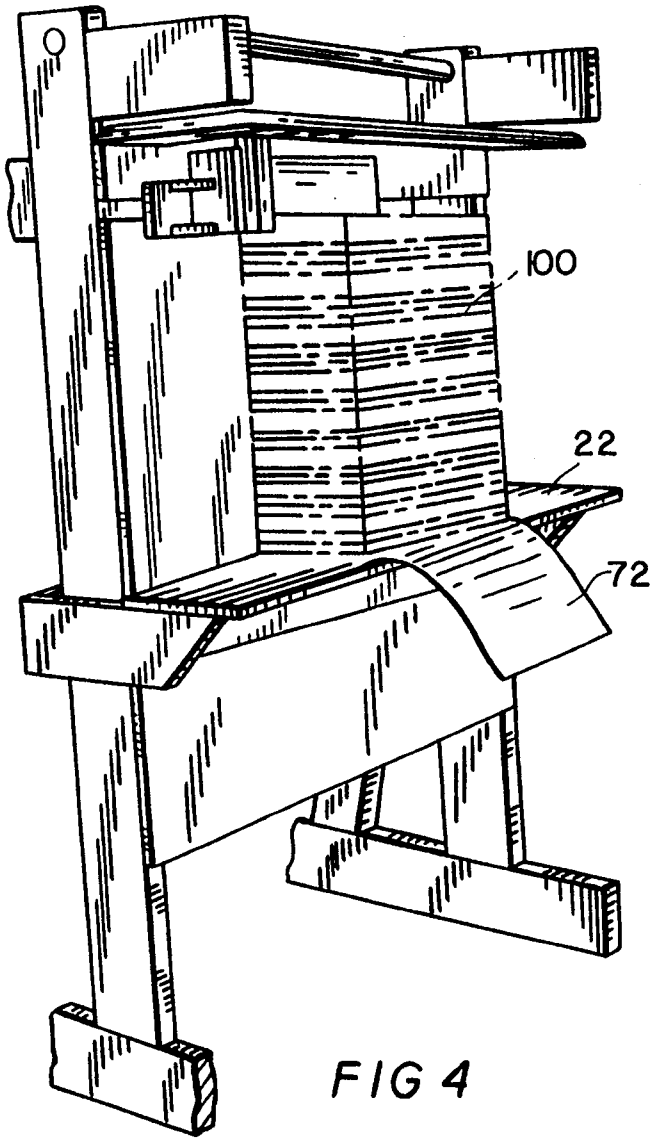
FIG. 4 shows the apparatus of FIG. 4 with the object to be bundled disposed on the wrapping paper and not yet compressed.
Figure 3:
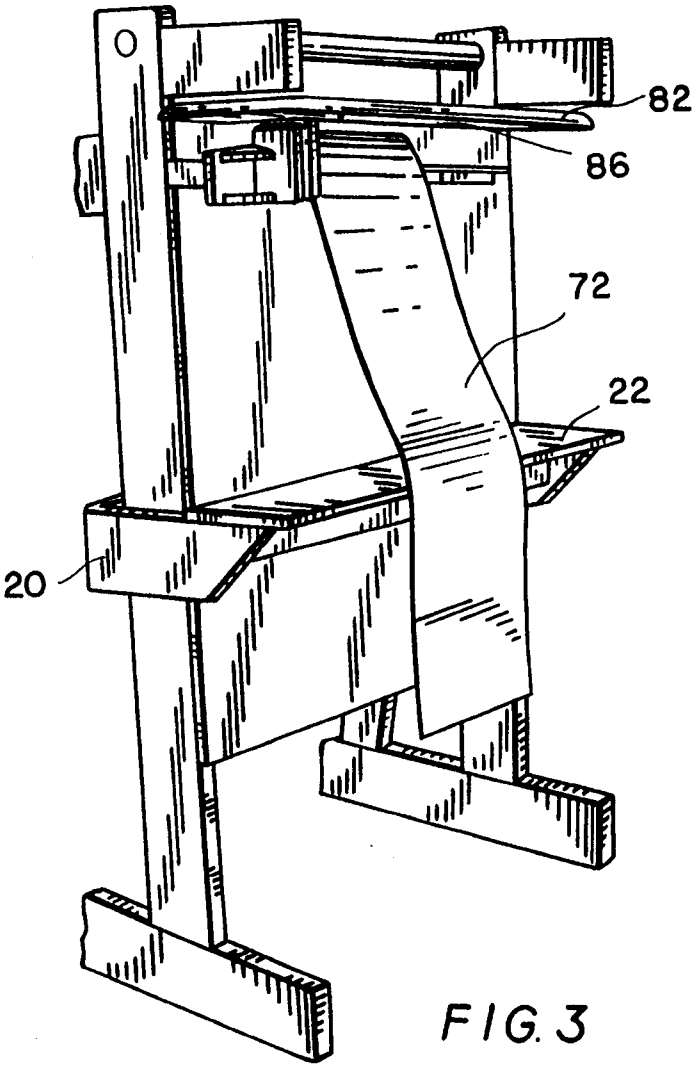
FIG. 3 shows a partial isometric view of the apparatus with the wrapping paper paid out.
Figure 6:
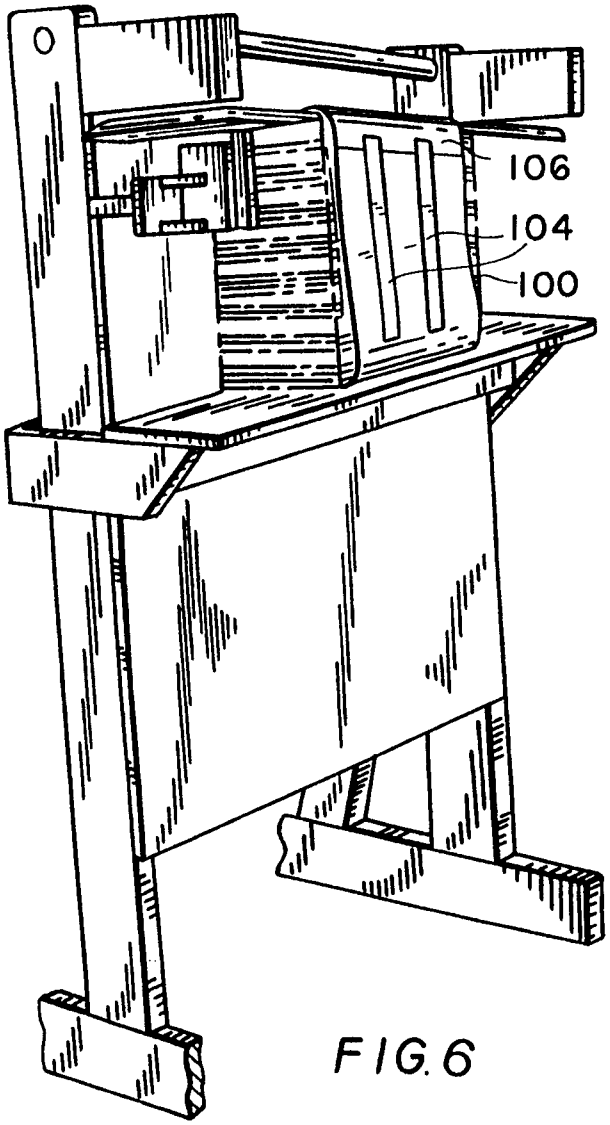
FIG. 6 shows the formation of the bundle.

Referring now to FIGS. 1 and 2, the bundler apparatus 10 constructed in accordance with this invention consists of a first pair of uprights 12, 14 secured to a lower frame 16 attached to casters (not shown). A back plate 18 having a front face 19 extends between and is mounted on the uprights 12, 14. As shown in FIG. 1, the uprights 12, 14 are shaped or arranged in such a manner that plate 18 is offset from a vertical plane by about 5°–10°.

Mounted on the uprights is a bottom platen 20. The platen 20 includes a platform 22 extending forwardly of and perpendicularly plate 18, two side walls 24, 26 disposed adjacent to uprights 12, 14, and a back plate 28 extending behind plate 18 and coextensive with platform 22. The platen 20 is also provided with rollers 30 mounted to allow the platen to ride up and down on the uprights 12, 14.

Behind uprights 12, 14 is a second pair of uprights secured to lower frame 16 with upright 32 being visible in FIG. 1. This second pair of uprights is parallel to the first pair and support two horizontal channels 34, 36. The bundler 10 is also provided an air cylinder 38, said air cylinder 38 having a tubular housing 40 and a piston 42 reciprocating within the housing 40 in parallel with back plate 18. As shown in FIG. 2, cylinder 38 is preferably disposed midway between the vertical sides of the back plate 18.

Piston 42 is terminated with two extensions 44, 46 rotatably supporting a shaft 48. Mounted at the ends of shaft 48 are two sprocket wheels 50, 52. Trained around each wheel 50, 52 is a chain 54, 56. One end of each chain is secured to the channel 34 while the other end is secured to back wall 28 or bottom platen 20.

Behind the second pair of uprights, there is provided paper supply support 58 for holding a removable free turning shaft 60. Mounted on shaft 60 is a roll 62 of wrapping paper.

On top of the uprights there is an upper frame 64 for holding a rear of rubber roller 66, and a front pair of rollers 66' and an electric motor 68. A belt 70 is used to selectively drive one of the front knurled rollers 66' to selectively pay off a continuous sheet of wrapping paper 72. Adjacent to the front rollers 66', there is a cutting disk 74 arranged to move transversally across the paper sheet 72 exiting from rollers 66'. The disk 74 is alternately advanced and retracted across sheet 72 by a second air cylinder 76.

At the top of the first pair of uprights 12, 14, extending forwardly are two vertical walls 78, 80. Suspended from walls 78, 80 is a top platen 82. Unlike bottom platen 20, top platen 82 is fixed. A bar 84 extends between the tops of the uprights 12, 14 for protection.

Between the bottom surface of top platen 82, and the top edge of back plate 18 there is a slot 86 which allows the paper from the rollers 66' to paid off towards bottom platen 20. Under slot 86, a second slot 88 is made in back plate 18. An arm 90 is mounted through slot 88. A third air cylinder 92 is used to reciprocate arm 90 along the width of plate 18 as shown by double arrow A.

Under the bottom platen there are a plurality of foot pedals 94, 96, 98. The operation of these pedals shall be described more fully below.

The operation of the bundler apparatus is now described in conjunction with FIGS. 3–7. Starting with FIG. 3, a sheet of wrapping paper 72 is paid off through slot 86 to extend over the platform 22.

Figure 5:
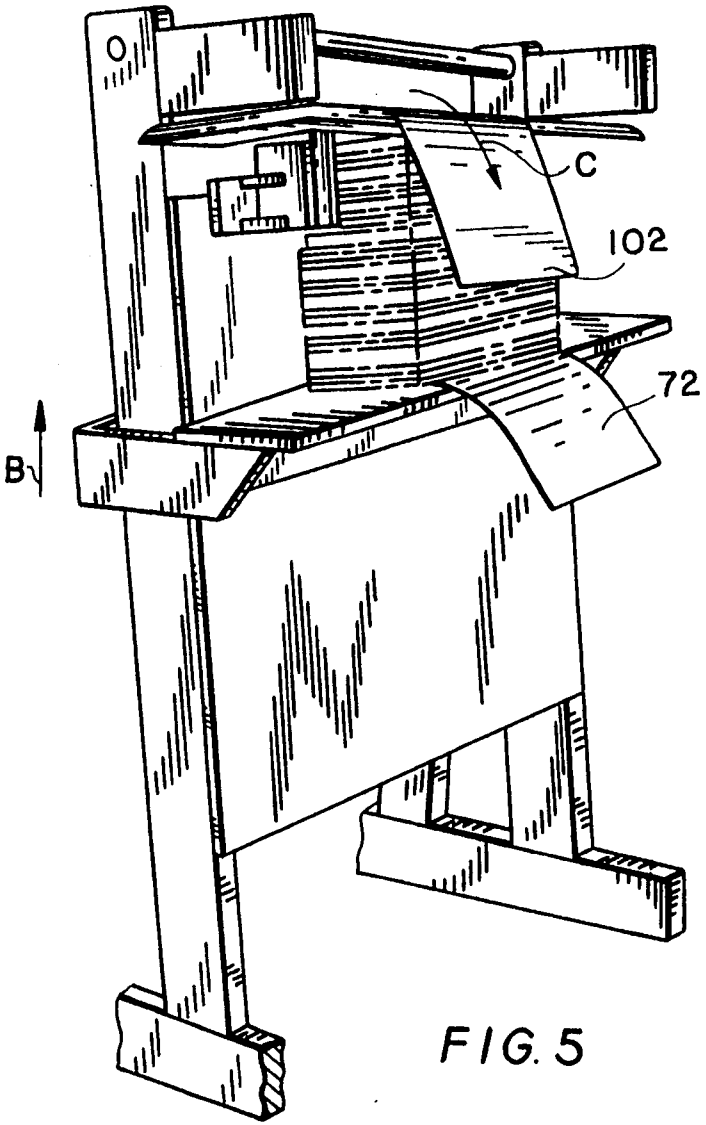
FIG. 5 shows the wrapping paper paid out over the compressed object.
Figure 7:
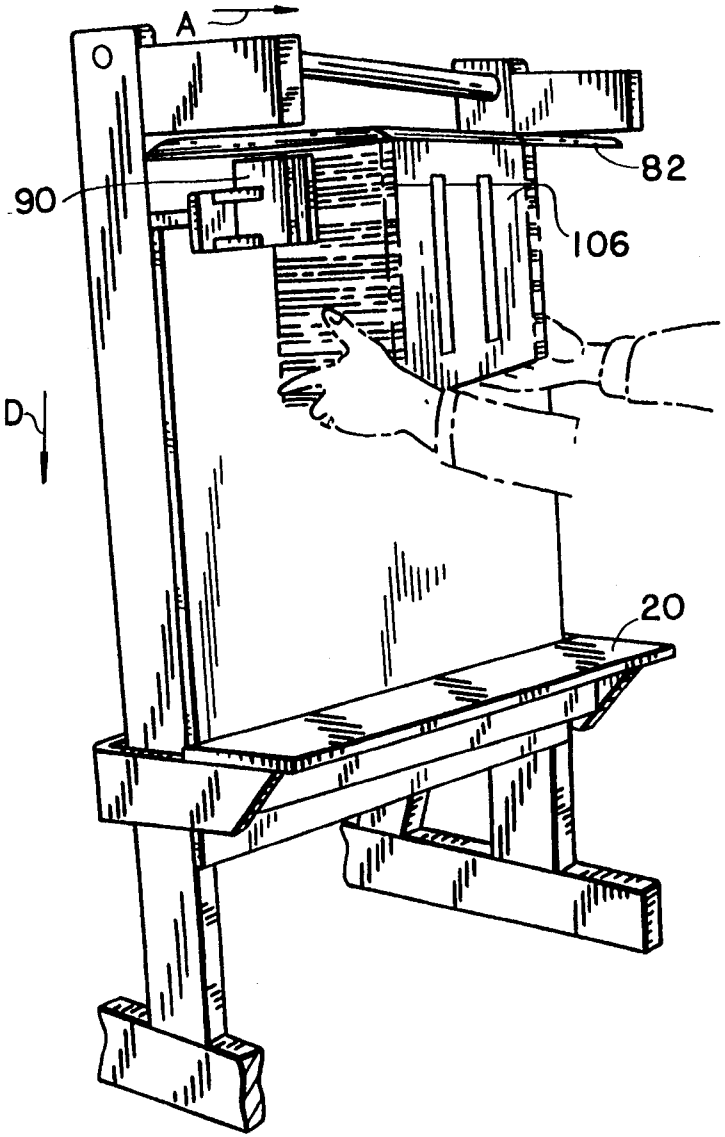
FIG. 7 shows the removal of the bundle.

Next (FIG. 4) a stack 100 of objects, for example bags, is placed on platform 22 so that it is disposed on top of the sheet 72. Because of the orientation of back plate 18 and the platform 22, the stack is tilted slightly backwards to rest on the back plate thereby insuring that it will not topple over. The platen 20 is raised by activating air cylinder 38 thereby raising the stack 100 in the direction of arrow B and compressing it against upper platen 82 as shown in FIG. 5. The cutter disk 74 is then activated to cut off the sheet 72. The upper end 102 of the sheet is pulled from the back of the plate 18, as indicated by arrow C over the top platen 82 to hang downwardly along the face of stack 100 as shown.

Next (FIG. 6) the two ends of the sheet 72 are overlapped and taped together, for example by adhesive tapes 104. In this manner a tight bundle 106 is formed of stack 100.

Next, (FIG. 7) platen 20 is lowered as shown by arrow D. To remove the bundle 106, cylinder 92 is activated causing arm 90 to move to the right as indicated by arrow A thereby removing bundle 106 from upper platen 82. The bundle 106 is caught before it drops to the floor.

Figure 8:
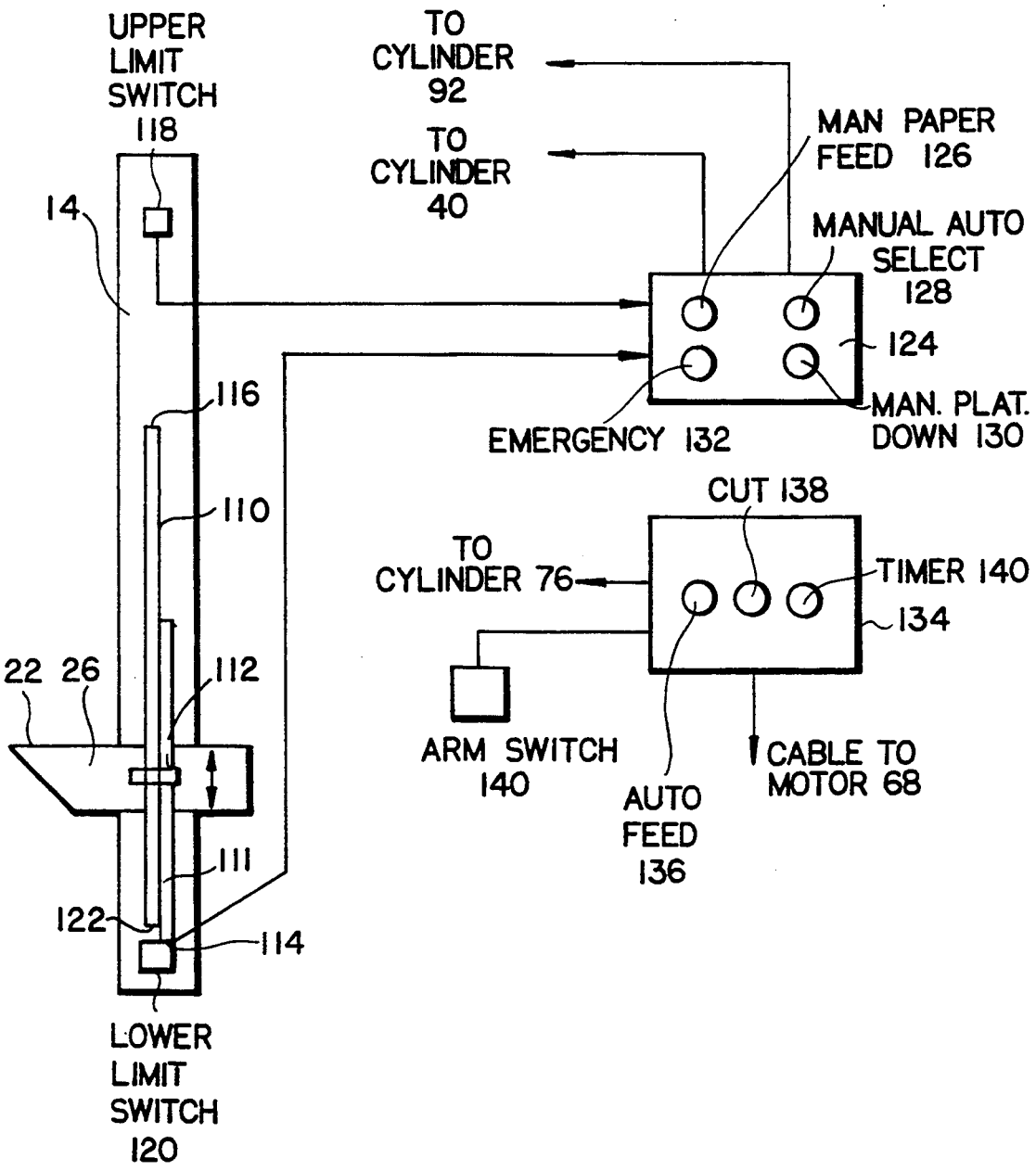
FIG. 8 shows in a somewhat schematic manner the control means for the apparatus.

The bundling apparatus 10 can be operated in a variety of modes to perform the above-described steps, by providing various controls for the electric motor and the cylinders. For example, as shown in FIG. 8, the right upright 14 can be used to monitor the position of the bottom platen 20. Platen 20 may be provided on wall 26 with a pair of rows 110 and 111 extending substantially parallel to upright 14. Rods 110 and 111 are attached to wall 26 by a bracket 112 so that the rod 110 can be affixed with its upper tip 116 disposed at a certain height above platform 22. This height may be changed by loosening bracket 112 and sliding the rods 110 and 111 up or down as desired. On upright 14 there also two limit switches: an upper limit switch 118 and a lower limit switch 120. The upper limit switch 118 is activated when it is reached by the upper end 116 of rod 110. The lower limit switch 120 is activated when it is reached by the lower end 114 of the other rod 111 reaches it.

The two limit switches are coupled to a control panel 124. This panel is the operator's control station and is used to operate the apparatus, including the movement of the bottom platen 20. Arm 90 is automatic. It is only activated when platen 20 reaches lowest position preset by arm 111. Panel 124 has four buttons. Button 126 is used for feeding the paper sheet 72 manually. Button 128 is a selection button to select a manual or automatic operation. Button 130 is used as an optional means of lowering the platen 20. Button 132 is an emergency button that stops all electrical and pneumatic functions (i.e. if operator's hand is caught in the machine).

A second control panel 134 is also provided to set up the apparatus prior to the bundling operation. This panel includes three buttons. Button 136 is used to activate the electric motor to pay out a preselected length of wrapping paper 72. Button 138 is used to activate the cutter disk. Button 140 is a rotary button used to select the length of paper to be paid out when the button 134 is activated. In other words, motor 68 may be activated for a time period selected from button 140. The two panels 130, 134 may be placed any where adjacent to or even mounted on the apparatus 10. The control panels 124, 134 and foot pedals 94, 96, 98 are connected by air hoses and/or electrical cables to the cylinders 40, 76, 92 and the motor 68 to provide proper operation thereof.

When button 128 is placed in the automatic position, the apparatus operates as follows.

First the operator adjusts the rod 110 to a preset position dependent on the height of the stack to be bundled. He also sets the length of wrapping paper necessary for the stack by adjusting rotary button 140. The operator presses the autofeed button 136 to obtain a preselected length of paper 72 which is fed unto the platform 22. The apparatus is now ready for automatic operation. For each stack of bags the following steps are repeated.

The operator first places a stack of bags 100 on the platform 22 and presses on the up foot pedal 94. The platform 22 then moves up until stack 100 is in contact with and compressed against the upper platen 82. When a preselected compression is reached, i.e. when top end 116 reaches sensor switch 118, the upward movement is automatically stopped. The operator then steps on the cutter pedal 96 causing the air cylinder 76 to advance or retract the cutter disk 74 thereby cutting the paper. The operator wraps the stack 100 with the paper 72 and then applies the tapes 104. Next, he steps on the down pedal 98. This causes the platform 22 to move down, away from the bundle 106. When the platform reaches its bottom position as indicated by switch 120, cylinder 92 is operated automatically to cause the arm 90 to move to the right thereby pushing bundle 106 off top platen 82. After the bundle is pushed off the arm 90 is automatically returned to its left-most position. This position is sensed by an arm switch 140 which causes the control panel 134 to activate the motor to feed yet another sheet of wrapping paper 72.

For manual operation, selected with button 128, the same sequence occurs except that the operator keeps his foot on the up foot pedal 94 until he decides that the platform 22 has reached the top position, i.e. when in his experience proper compression has been applied to the bags.

Clearly, the apparatus described above achieves the desired objectives. It is capable of handling much larger stacks than the prior art. It can be easily adapted for automated or semi-automated operation. It is faster, easier to operate and safer than the prior art.

Obviously numerous modifications may be made to the apparatus described above without departing from its scope as set forth in the appended claims.

I claim:

1. An apparatus for bundling articles comprising:
support frame means;
a back plate mounted on said support frame means and having a front plate surface;
bottom platen mounted on said support frame for holding a stack of articles;
top platen means mounted on said support means;
wrapping feed means for feeding a sheet of wrapping having a first end and a second end, with said sheet having said first end being positioned over said bottom platen, with said stack of articles being disposed on top of said sheet on said bottom platen and said second end being positioned over said top platen;
platen reciprocating means for vertically reciprocating one of said top and bottom platens to compress said stack between said platens adjacent to said front surface, said platen reciprocating means including an expanding member disposed away from said front surface;
whereby after said stack is compressed between said top and bottom platens, said first and second end are joined to form a bundle, said bundle including said stack of articles and said top platen extending under said wrapping.

2. The apparatus of claim 1 wherein said front surface is tilted with respect to a vertical plane.

3. The apparatus of claim 1 wherein said platen reciprocating means includes an expandable member including a tubular housing disposed behind said back plate, a piston disposed in said tubular housing and selectively movable with respect to said housing, and coupling moves for coupling said piston to said one platen.

4. The apparatus of claim 1 further comprising a supply of a continuous wrapping sheet, and sheet feed means for feeding said sheet toward said bottom platen.

5. The apparatus of claim 4 further comprising means for cutting said sheet.

6. A bundling apparatus comprising:
a first and a second upright;
a plate mounted on said uprights;
a top platen secured to said uprights;
a bottom platen reciprocating between a first and a second position along said plate;
reciprocating means disposed behind said plate for reciprocating said bottom platen;
wrapper supply means for providing a sheet of wrapping having a first end disposed over said bottom platen and a second end disposed over said top platen;
wherein said reciprocating means is arranged and constructed to raise said bottom platen with said sheet and said stack for compressing said stack between said bottom and top platens, with a bundle being formed by securing said first and second ends together with said top platen extending into said bundle; and
bundle removal means for removing said bundle from said upper platen.

7. The apparatus of claim 6 wherein said reciprocating means comprises an air cylinder and coupling means for coupling said air cylinder to said bottom platen.

8. The apparatus of claim 7 wherein cylinder includes a fixed housing, a movable piston reciprocating in said housing, and said coupling means includes an elongated member engaged with said piston and having a first end which is fixed, a second end secured to said bottom platen.

9. The apparatus of claim 8 wherein said elongated member is a chain and said coupling means further comprises a sprocket wheel mounted on said piston, with said chain being trained around said sprocket wheel.

10. The apparatus of claim 6 further comprising cutter means for selective cutting of said wrapping.

11. The apparatus of claim 6 wherein said removal means includes an arm disposed adjacent to said top platen and arm control means for selectively reciprocating said arm in a generally horizontal plane.

12. The apparatus of claim 6 wherein said plate is offset from a vertical plane.

13. The apparatus of claim 6 wherein said top platen is rigidly secured to said frame.

* * * * *